United States Patent [19]

Scott

[11] Patent Number: 4,907,311

[45] Date of Patent: Mar. 13, 1990

[54] SHOE TREE

[76] Inventor: Wayne Scott, Rt. 1, Box 48, Saunemin, Ill. 61769

[21] Appl. No.: 201,768

[22] Filed: Jun. 2, 1988

[51] Int. Cl.[4] ..... A43D 5/00

[52] U.S. Cl. ..... 12/120.5; 211/34

[58] Field of Search ..... 12/120.5, 122, 123, 12/123.5, 125, 126; 211/34, 35

[56] References Cited

U.S. PATENT DOCUMENTS

| | | | |
|---|---|---|---|
| 347,023 | 11/1887 | Watts | 12/120.5 |
| 1,106,465 | 8/1914 | Loomis | 12/120.5 |
| 2,266,258 | 12/1941 | Peirce et al. | 12/120.5 |
| 2,340,463 | 2/1944 | Gano, Jr. | 12/120.5 |
| 2,383,651 | 8/1945 | Hill | 211/34 |
| 2,462,611 | 2/1949 | Bye | 211/34 |
| 2,479,187 | 9/1951 | Tomlin | 12/129.1 |
| 2,566,656 | 9/1951 | David | 211/34 |
| 2,587,971 | 3/1952 | Crawford | 12/120.5 |
| 2,883,688 | 4/1959 | Barreca | 12/120.5 |
| 3,040,900 | 6/1962 | Jones | 211/35 |
| 3,210,787 | 10/1965 | Allsop | 12/120.5 |
| 3,237,226 | 3/1966 | Gjesdahl | 12/120.5 |
| 3,397,416 | 8/1968 | Celli | 12/120.5 |
| 3,497,891 | 3/1970 | Voster et al. | 12/120.5 |
| 4,277,006 | 7/1981 | Pinckard | 12/120.5 |

*Primary Examiner*—Steven N. Meyers

*Attorney, Agent, or Firm*—Willian Brinks Olds Hofer Gilson & Lione

[57] ABSTRACT

A shoe tree which is applied externally to an article of footwear has a base with a toe grip provided on the front portion of the base, and a heel grip provided on the rearward portion of the base. The heel grip is received and is vertically movable on a post which extends generally vertically from the rearward base portion. A preferred embodiment utilizes a post having a roughened exterior and a heel grip having a throughbore which is slightly larger than the diameter of the post, which is received within the heel grip throughbore. When the heel grip is positioned on the heel of the footwear, the heel grip is tipped rearwardly under the natural bias of the flexed sole to thereby frictionally engage the throughbore wall with the roughened post exterior to fix the heel grip in place on the post and maintain the footwear sole in a straightened condition.

7 Claims, 2 Drawing Sheets

SHOE TREE

FIELD OF THE INVENTION

The present invention relates to a shoe tree applied to the exterior of a shoe, boot or other similar article of footwear.

BACKGROUND OF THE INVENTION

The shoe straightening devices to which the present invention relates are commonly known as shoe trees. Shoe trees are generally of two types: the well-known internally applied shoe tree which fits within a shoe and is expanded; and the lesser known type of shoe tree that is applied externally to footwear. Shoe trees in general are used for preventing shoes, as well as boots and other articles of footwear, from losing their shape and becoming creased. As used hereafter, the term "shoe tree" is meant to encompass such devices that are applied to shoes, boots and other articles of footwear.

Shoe trees that are applied internally have two significant disadvantages compared to externally applied shoe trees. One disadvantage is that the internally applied shoe tree operates by pressing the material of the shoe outwardly in order to uncrease it. The shoe upper thus becomes stretched over time. A second significant disadvantage of internally applied shoe trees is the inherent difficulty in applying the shoe tree in a boot. Most internally applied shoe trees simply cannot be made to "turn the corner" in passing from the vertical length or shank of the boot to the horizontal sole portion, or can only do so with great difficulty.

External shoe-trees are generally of universal application to any kind of footwear since they are applied to the outside of the footwear. The external shoe tree also does not distend the footwear upper, since it primarily acts to straighten the sole of the shoe to remove creases. External shoe trees are represented by U.S. Pat. No. 1,106,465 and U.S. Pat. No. 2,266,258, for example.

SUMMARY OF THE INVENTION

The principal objective of the invention is to provide an improved externally applied shoe tree which is formed of a minimal number of pieces for economic manufacture, with simplicity in construction and operation, and that is easy to use. The inventive shoe tree is furthermore adjustable to any size of footwear without the necessity of manipulating any bolts, wingnuts, or the like, and without the need for any adaption of or mutilation of the footwear in use of the shoe tree.

In accordance with these and other ends, the present invention in an external shoe tree comprises a base with a toe grip formed on the base. The toe grip is adapted to grip and hold the toe of the footwear in place relative to the base, and conveniently comprises a ledge having an undercut portion in which the toe of the shoe sole is received.

A heel grip is adapted to grip the heel of the footwear, as by catching the heel of the shoe sole at its rearward end between the top of the sole and the heel portion of the upper. A post extends generally vertically from the base, and the heel grip is received on the post and is vertically movable thereon. A means for releasably fixing the heel grip in place on the post is further provided, and operates by forcing the heel against the natural bias of the flexed sole of the footwear in a direction toward the base thereby straightening the sole of the footwear to remove creases from the footwear upper.

A number of different embodiments of the means for releasably fixing the heel grip in place on the post are presently contemplated. One embodiment, for instance, comprises a roughened exterior formed on the post. A bore is formed through the heel grip and is defined by a bore wall. The bore has a diameter which is sufficiently larger than the diameter of the post to permit the heel grip to tip, with the bore axis thereby skewed relative to the post axis when the heel grip is applied. That is, when the heel grip is pressed against the natural bias of the sole to straighten the latter, the heel grip is tipped rearwardly. Portions of the bore walls then frictionally engage the roughened exterior of the post under the bias of the sole to thereby fix the heel grip in place. The heel grip is quite plainly easily moved up and down on the post and readily applied to the heel of the footwear.

Another embodiment for releasably fixing the heel grip in place comprises screw threads formed on the post. The bore formed through the heel grip has matching screw threads formed on the bore wall. The heel grip is threaded onto the post, and is rotated up and down the post to position the heel grip.

Yet another embodiment for releasably fixing the heel grip in place comprises a heel grip slidably received on the post, with a spring mounted concentric with the post biasing the heel grip toward the base. The heel grip is pressed against the bias of the spring to position it on the heel of the footwear, and then released, with the spring tension pressing the heel grip toward the base to straighten the sole.

A preferred embodiment of the base provides for front and rear portions for the base which are separate elements movable relative to each other. For example, one of the front and rear portions has a channel track formed therein with the other of the front and rear portions having a rail which is received in the channel track. This arrangement permits sliding extension and contraction of the base. The base can accordingly be adjusted to various shoe sizes, and further facilitates positioning of the heel grip. The channel and rail combination can be located along the longitudinal axis of the base, or on the lateral sides of the base.

Yet another embodiment of the invention provides for the base to be a single piece with the post movably mounted on a slidable bracket for adjustability.

The invention will be further understood upon consideration of the following detailed description of some embodiments of the invention taken in conjunction with the accompanying drawings, in which:

DETAILED DESCRIPTION OF SOME EMBODIMENTS OF THE INVENTION

Figure 1:
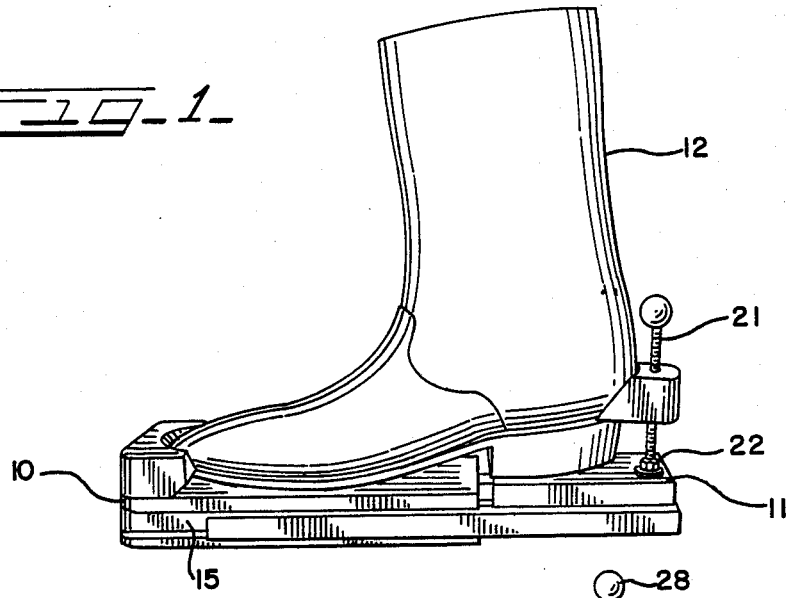
FIG. 1 is a side view of an external shoe tree made in accordance with the teachings of the present invention, as applied to a boot.
Figure 2:
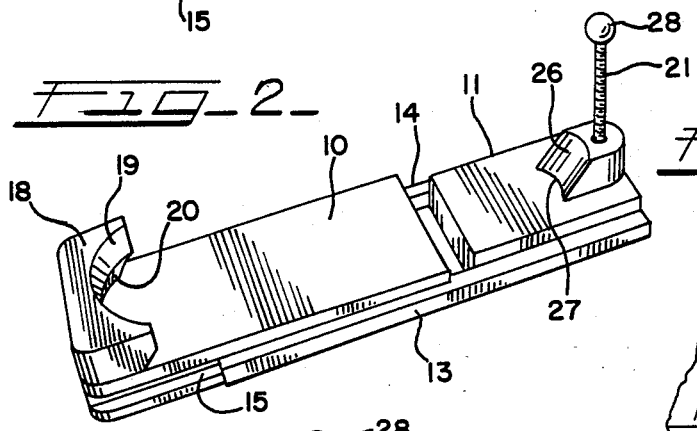
FIG. 2 is a perspective view of the shoe tree of FIG. 1 with the boot removed.
Figure 3:
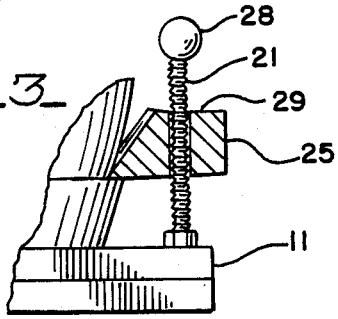
FIG. 3 is an enlarged fragmentary view of the rearward portion of the shoe tree of FIG. 1.

With reference to FIGS. 1 through 3, a first embodiment of the invention comprises a base having a forward portion 10 and a rearward portion 11. For purposes of this description, forward, rearward, front, back, up and down and the like are relative to FIG. 1, which shows a boot 12 in what would be considered an upright position with the boot toe at the front of the boot tree.

As particularly shown in FIGS. 1 and 2, the forward and rearward portions 10, 11 of the base are slidable relative to each other to adjust the longitudinal length of the base. This enables ready adjustability of the shoe tree to accommodate varying sizes of footwear. To this end, the rearward base portion 11 has a pair of lateral rails 13 and 14 which are formed on the sides of the rearward base portion 11 and extend forwardly from the rearward base 11. The rails 13, 14 are received in channels 15 formed in the lateral sides of the forward base portion 10, only one of which is illustrated here. It will be understood that a like channel to that illustrated at 15 is formed on the opposite side of the forward base 10.

The rails 13, 14 and channels 15 are sized so that the base portions 10 and 11 are freely slidable relative to each other, yet are not so loosely fit that either of the forward or rearward base portions 10, 11 may significantly pivot out of the general plane of the shoe tree base. The particular base illustrated herein was made from hardwood. Other materials are obviously adaptable for making the base as well as other elements of the shoe tree. For example, the principal components of the shoe tree could be made from sturdy plastic, as by injection molding. The shape of the base is also not considered to be confined to the rectangular shaped forward and rearward base portions, but could obviously take any number of different shapes, as desired.

A toe grip 18 is mounted at the front end of the forward base portion 10. The toe grip 18 has a rearward facing concavity 19 formed therein which is undercut to make a ledge 20. It is beneath this ledge 20 that the upper edge of the toe of the boot sole is received and caught. It has been found advantageous to form a relatively sharp edge between this ledge 20 and the concavity 19, with the edge thereby being able to slip into the gap typically formed between the top of the sole and the upper. This ensures a sure grip by the toe grip 18. The vertical clearance allowed between the top of the forward base portion 10 and the bottom of the toe grip ledge 20 is made sufficient to accommodate the vertical width of common footwear soles.

A vertically extending post 21 is mounted at the back of the rearward base portion 11. In this embodiment, post 21 takes the form of a screw threaded rod. The rod 21 is screwed into the rearward base 11 and retained in place with a retaining nut 22.

A heel grip 25 is carried on the rod 21. The heel grip has a sloped concavity 26 similar to that of the toe grip concavity 19. The concavity 26 terminates in a relatively sharp edge 27 which is designed to fit in the gap typically between the heel and upper. The underside of the heel grip 25 adjacent this edge 27 operates in the same fashion as the ledge 20 of the toe grip 18.

In the embodiment shown in FIGS. 1 through 3, the heel grip 25 is freely slidable on the rod 21. A knob 28 may be provided at the top of the rod to capture the heel grip 25 thereon. The heel grip 25 is fixed in place by applying the toe of the boot 12 in the toe grip 18, and then positioning the heel grip edge 27 on the heel of the boot 12. The heel grip 25 is then pressed toward the rearward base portion 11 against the natural bias of the boot sole (which ordinarily would have a tendency to curve upwardly relative to the base).

Once the sole is straightened as desired, the heel grip 25 is released. The heel grip 25 is retained in position on the rod 21 through frictional engagement between the rod 21 and heel grip 25. Specifically, the heel grip 25 has a throughbore 29 that is defined by a sidewall with a diameter at least slightly greater than that of the threaded rod 21. This causes the heel grip 25 to be tipped rearwardly by the upward force applied by the sole. The throughbore sidewall thereby frictionally engages with the threads of the rod 21 to "pin" the heel grip 25. The heel grip has a slight downward cant so that it is generally horizontal when applied to the shoe. Boring the throughbore 29 slightly off-axis can provide the desired angulation.

It will be appreciated from the foregoing how easily the shoe tree of this invention is applied and adjusted. A minimal number of components which are easily manufactured comprise the shoe tree, thus lending it to ready manufacture.

Figure 4:
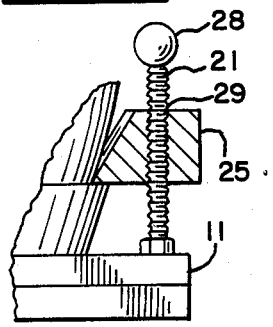
FIG. 4 is a view similar to that of FIG. 3 of another embodiment of the heel gripping mechanism.

Another embodiment of the shoe tree of the present invention is shown in FIG. 4. In this embodiment, the only change from the embodiment discussed with reference to FIGS. 1 through 3 is that the throughbore 29 of the heel grip 25 is match-threaded to the threaded rod 21. Vertical location of the heel grip 25 is accomplished by rotating the heel grip 25 to screw it up or down the rod 21.

Figure 5:
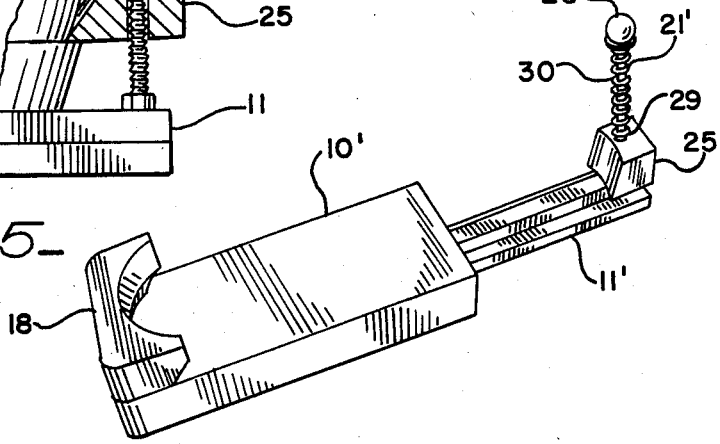
FIG. 5 is a perspective view of another embodiment of a shoe tree made in accordance with the teachings of the present invention.

Another embodiment of the invention is shown in FIG. 5. In this embodiment, no side channels are provided on the forward base portion 10'. (Prime numbers indicate similar but modified parts to their unprimed counterparts.) Rearward base portion 11' takes the form of a shaft 11' that is slidably received in a channel (not shown) formed along the longitudinal axis of the forward base portion 10'. A smooth post 21' extends vertically from the back of the shaft 11'. A throughbore 29 in the heel grip 25 is slightly wider in diameter than the post 21' so that the heel grip 25 freely slides on the post 21'.

A spring 30 is mounted concentric with the post 21' and is held at one end by the bottom of the knob 28, with the other end of the spring bearing against the top of the heel grip 25. The spring 30 thus biases the heel grip 25 toward the rearward base portion or shaft 11'. The spring tension is made sufficient to straighten the footwear sole by pressing it toward the base via the heel grip 25, but not so great as to present a problem in pushing the heel grip 25 against the spring bias to position the heel grip.

Figure 6:
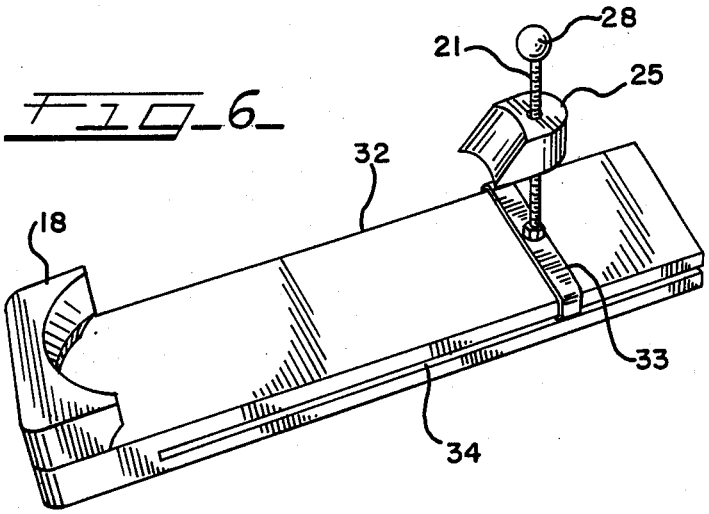
FIG. 6 is yet another embodiment of a shoe tree made in accordance with the teachings of the present invention.
Figure 8:
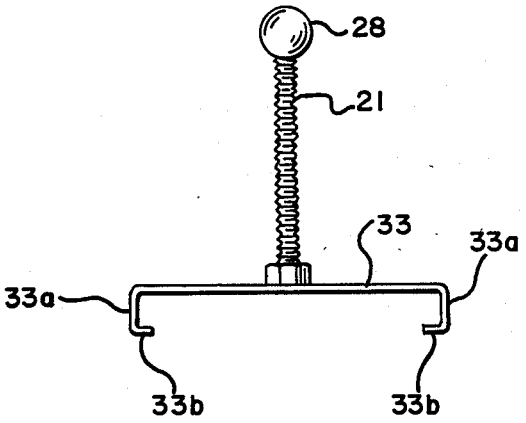
FIG. 8 is a view of the post and bracket combination shown in FIG. 7.
Figure 7:
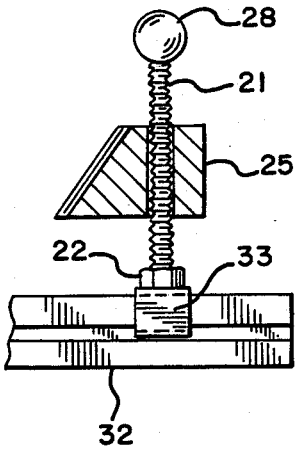
FIG. 7 is an enlarged fragmentary view of the rearward portion of the shoe tree of FIG. 6.

Yet another embodiment of the invention is shown in FIGS. 6 through 8. In this embodiment, a single piece base 32 is provided. Rod 21 is fixed to the mid-portion of a rigid U-shaped bracket 33 to extend generally vertically from the back of the base 32. Arms 33*a* depend from each side of the mid-portion of the bracket 33, and have in-turned flanges 33*b*. These flanges 33*b* are received in channels 34 (only one of which is shown here) which extend along the lateral sides of the base 32. The bracket 33 can thus be slid longitudinally along the base into position.

Thus, while the invention has been described with reference to a number of present embodiments, those with skill in the art will recognize modifications of material, structure, arrangement and the like which will still fall within the scope of the invention.

What is claimed is:

1. A shoe tree applied to the exterior of a shoe, boot or other article of footwear comprising:

a base;

a toe grip formed on said base adapted to grip and hold the toe of the footwear in place relative to said base, a heel grip adapted to grip the heel of the footwear, a generally vertically extending post on said base upon which said heel grip is received and is vertically movable thereon, and a roughened exterior formed on said post, said post having a longitudinal axis and a diameter, and a bore formed through said heel grip defined by a bore wall, said bore having a longitudinal axis and being sufficiently larger in diameter than said diameter of said post to permit said heel grip to tip with said bore axis thereby skewed relative to said post axis, portions of said bore wall being frictionally engaged with said post roughened exterior under the natural base of a flexed footwear sole to fix said heel grip in place and thereby straighten the sole.

2. The footwear straightener of claim 1 wherein said front portion and rear portion of said base are separate elements which are movable relative to each other.

3. The footwear straightener of claim 2 having a base with separate front and rear portions which are movable relative to each other wherein one of said front and rear portions has a channel track formed therein, and the other of said front and rear portions has a rail received in said channel track for sliding extension and contraction of said base.

4. The footwear straightener of claim 2 having a base with separate front and rear portions which are movable relative to each other wherein one of said front and rear portions has a channel track formed on opposite lateral sides thereof, and the other of said front and rear portions has a rail formed on opposite lateral sides thereof, each rail received and held in a respective channel tack for sliding movement of said base portions.

5. The footwear straightener of claim 2 having a base with separate front and rear portions which are movable relative to each other wherein said base rear portion is a rail, said front portion having a longitudinally extending channel track formed therein within which said rail is slidably received and held for extension and contraction of said base.

6. A shoe tree applied to the exterior of a shoe, boot or other article of footwear comprising:

a base;

a toe grip formed on said base adapted to grip and hold the toe of its footwear in place relative to said base, a heel grip adapted to grip the heel of the footwear, a bracket slidably mounted for longitudinal movement on said base, said bracket having a generally U-shape with the base of said U-shape adjacent an upper surface of said base, with inwardly extending ears formed on the legs of said U-shape which ears are received in channels formed in lateral sides of said base and slidable therein to adjust said bracket, a generally vertically extending post fixed to and extending from said bracket upon which said heel grip is received and is vertically movable thereon, and means for releasably fixing said heel grip in place on said post with said heel grip engaged with the heel of the footwear and forcing said heel against the natural bias of the flexed sole of the footwear towards said base to straighten the sole of the footwear.

7. A shoe tree applied to the exterior of a shoe, boot or other article of footwear comprising:

a base, a toe grip formed on said base adapted to grip and hold the toe of the footwear in place relative to said base, a heel grip adapted to grip the heel of the footwear, a bracket mounted for longitudinal movement on said base, a generally vertically extending post fixed to and extending from said bracket upon which said heel grip is received and is vertically movable thereon, said post having a roughened exterior, a longitudinal axis and a diameter, said heel grip having a bore formed therethrough defined by a bore wall, said bore having a longitudinal axis and being sufficiently larger in diameter than said post diameter to permit said heel grip to tip with said bore axis thereby skewed relative to said post axis, portions of said bore wall being frictionally engaged with said post roughened exterior under the bias of the footwear sole to fix said heel grip in place on said post.

* * * * *